United States Patent [19]

Koblo et al.

[11] 4,317,026

[45] Feb. 23, 1982

[54] DEVELOPING CHAMBER

[75] Inventors: Jochen Koblo, Wiesbaden-Auringen; Götz von dem Bussche, Schwalbach, both of Fed. Rep. of Germany

[73] Assignee: Hoechst Aktiengesellschaft, Fed. Rep. of Germany

[21] Appl. No.: 133,894

[22] Filed: Mar. 25, 1980

[30] Foreign Application Priority Data

Mar. 28, 1979 [DE] Fed. Rep. of Germany ... 7908775[U]

[51] Int. Cl.[3] ..... H05B 1/00

[52] U.S. Cl. ..... 219/216; 219/388; 354/299

[58] Field of Search ..... 354/299, 300; 219/216, 219/388; 355/27, 100, 106; 430/353, 354

[56] References Cited

U.S. PATENT DOCUMENTS

| | | | |
|---|---|---|---|
| 3,230,089 | 1/1966 | Robinson et al. | 430/353 |
| 3,311,040 | 3/1967 | Ishikawa | 354/299 |
| 3,313,913 | 4/1967 | Limberger | 219/216 |
| 3,449,547 | 6/1969 | Goodman et al. | 219/388 |
| 3,629,549 | 12/1971 | Svendsen | 219/216 |
| 3,757,662 | 9/1973 | Ingels | 219/216 |
| 3,864,709 | 2/1975 | Bruns | 219/216 |
| 3,902,041 | 8/1975 | May | 219/388 |
| 4,052,732 | 10/1977 | Meadows | 355/106 |
| 4,116,559 | 9/1978 | Morokuma et al. | 219/216 |
| 4,147,422 | 4/1979 | Kahle et al. | 354/299 |
| 4,194,826 | 3/1980 | Lewis | 354/299 |

*Primary Examiner*—Michael L. Gellner
*Assistant Examiner*—Alan Mathews
*Attorney, Agent, or Firm*—James E. Bryan

[57] ABSTRACT

This invention relates to an improvement in a developing chamber for developing a photographic recording material for use in the vesicular method, comprising a housing and pairs of feed and discharge rolls therein, the improvement comprising at least two heatable metal blocks within said housing at an adjustable distance with respect to each other, whereby a gap for passage of recording material is provided, sliding enhancing material means on areas of the blocks facing the gap, the sliding enhancing material means being inert to the recording material, and temperature control means ensuring low temperature variations in the blocks.

6 Claims, 1 Drawing Figure

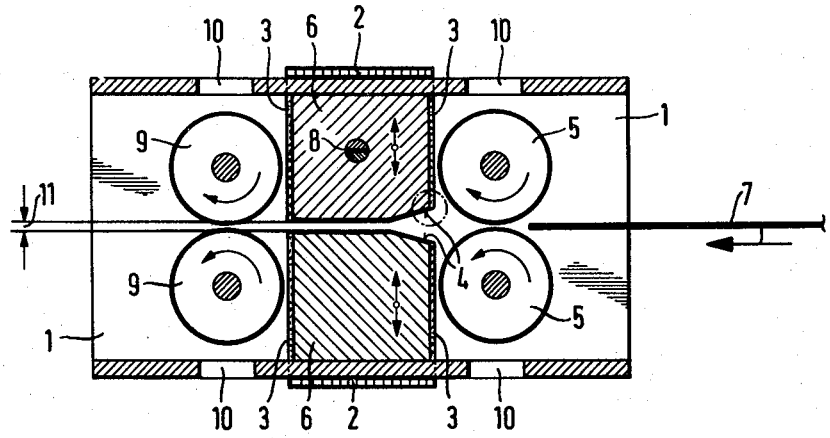
10
3
6
2
3
10
1
9
8
5
11
7
4
9
5
1
10
3
6
2
3
10
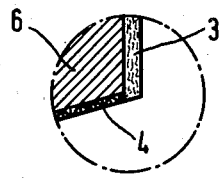
6
3
4

DEVELOPING CHAMBER

This invention relates to the development of a photographic recording material for the vesicular method, the material having a layer which optionally is on a layer support and is composed of a mixture of polymeric binders and a compound which is uniformly spread and splits off gas at exposure.

When these bubble-forming photographic recording materials are exposed, gas molecules, for example nitrogen molecules if a diazo compound is used, are split off from the light-sensitive material. The gas molecules at first remain invisibly distributed in the layer, but diffuse, however, during the heating process, as a consequence of the softening of the layer material, to gas-bubbles, which on their part, expand. Hence, the exposed areas become opaque in permeating light and transparent in incident light as a consequence of reflection and light scatter.

The principle of the vesicular method is known, but is has had no real success, as for example considerable difficulties arose due to the supply of coating materials, the exposure and the development. According to a known procedure, there is a pictorial exposure, when the recording material is brought into contact with a transparent copy and exposed. The material is then heated for 0.1 to 3 seconds at a temperature of 70° to 150° C., a negative of the copy resulting in this way. On the other hand there can be a pictorial exposure of the recording material if the gas, released within the layer, diffuses out of the light-sensitive layer after the exposure at a temperature which is too low for an image development. Then, the entire recording material is uniformly exposed and then developed for 0.1 to 3 seconds at a temperature between 70° and 150° C. This step takes place during or shortly after the second exposure, but before a substantial diffusion of the resulting gas out of the layer. As a result, an image development takes place in those areas which originally were not struck by light so that an image, analogous to the copy, is formed.

Several devices are known for the development of recording materials, as for example an apparatus in which the recording material, in the form of a film, is guided in the traverse through the apparatus with the coated side thereof adjacent a roll which has a temperature from 100° to 120° C. An aluminium roll having a highly polished surface is used for this purpose. It is, however, a disadvantage that the temperature control is evidently not fully satisfactory so that for example layer material sticks to the roll surface, the recording material becoming thus useless.

Furthermore, a developing apparatus is known, which comprises a chamber having a temperature between 100° and 120° C., in which the recording material is laid down, developed in about 2 to 3 seconds and removed from the chamber. Such a development has the disadvantage that it cannot be carried out uniformly as the material in the chamber warps and is therefore overdeveloped on warmer points. As a consequence, the image areas partially disappear according to the thermoplastic behaviour of the layer material.

A method which is also known for the development of bubble-forming photographic recording materials consists in using a conveyer belt for the materials, which is heated by a mercury vapor radiator working by pulses. Relatively high temperature variations which exceed ±4° C. result of this development. In this case a uniform development is not ensured either.

It is an object of the present invention to provide an apparatus for the development of bubble-forming photographic recording material, which ensures a uniform development over the entire image surface in the traverse of the material through the apparatus.

This object is achieved by a developing chamber for the development of a photographic recording material for the vesicular method, which comprises a developing housing and pairs of feed and discharge rolls. It includes two heatable metal blocks, which are adjustable at a distance with respect to one another, between which the recording material is guided, the metal blocks being provided in the passage area with a material which enhances sliding and does not attack the surface of the recording material. The chamber is further equipped with a temperature control device, which ensures temperature variations not exceeding 1%.

The metal blocks are heatable to temperatures within the range from 100° to 250° C., preferably from 100° to 140° C.

In a preferred embodiment, the developing chamber has a temperature variation of ±1.5° C. The developing chamber operates independently of its position; therefore it can guide the recording material either in a horizontal or in a vertical direction or in any direction therebetween.

The temperature in the developing chamber is primarely determined by the dwell time of the recording material in the chamber. As opposed to a relatively low temperature, elevated temperatures require a shorter dwell time. The dwell time itself also depends upon the exposure time of the material so that the developing chamber of the invention can be optimally adapted to all requirements.

The bubble-forming photographic recording material is quickly and uniformly developed and is, during the development, neither scratched on its surface, although it softens thermally, nor does the layer support, which is optionally used, change its planar position.

The developing chamber of the present invention will be further illustrated by reference to the accompanying drawing in which one embodiment thereof is shown in a sectional view.

The exposed recording material 7 which preferably is composed of a layer support and a light-sensitive layer thereon is introduced between the pair of feed rolls 5 which preferably are provided with a silicone coating or a coating of a fluorinated polymeric hydrocarbon. The arrangement of the layer side is not critical so that the material provided with the light-sensitive layer can be introduced either with its layer side up or down. The developing chamber 1 includes two metal blocks 6 which are composed for example of copper or brass or a similar metal, preferably, however, of aluminium or an aluminium alloy. It furthermore includes laminar radiators 2 which can be arranged either outside or inside of the blocks 6, and a material 4 which enhances sliding and does not attack the surface of the recording material. The material which enhances sliding is attached to the metal blocks in the passage area in order to prevent the formation of striations and scratches on the light-sensitive layer. The material 4 which enhances sliding may have a smooth surface; preferably, however, it is a fabirc. Materials such as silicone rubber or fluorinated polymers, especially polyamide, have proved successful. Simultaneously, the material which enhances sliding provides a uniform distribution of heat. The developing chamber 1 also contains the thermocouple 8 which controls the temperature range.

The recording material 7 passes through the developing chamber at a speed which is correlated with the preceeding period of exposure and which is, during the passage of the material, within the range of about 0.5 to about 7m/min.

The recording material is passed between the pair of discharge rolls 9 to a post-exposure unit (not shown) for the destruction of the remaining light-sensitive material. Then it can be used or stacked.

To avoid that the metal blocks 6 radiate heat onto the pairs of feed or discharge rolls, a protection 3 against heat, made for example of asbestos, is provided for each pair of rolls. Rolls of the pairs of rolls, immediately after operation, preferably are cooled off in order to avoid adverse effects on the recording material, which results in pre- or post-exposure. In this case, it also has proved suitable to provide the developing housing 1 with cutouts 10 which, on the inner wall of the housing, also can have the shape of holes or slots in order to obtain a uniform heat dissipation.

The height of the passage area 11 for the photographic recording material 7 in the developing chamber is adjustable. The adjustment is regulated in such a way that the distance between the coated surface of the metal blocks and the corresponding surface of the recording material is within the range from about 25 to 50 μm, preferably 30 μm. It has been found that such a distance is optimal for a uniform heating.

The laminar radiators 2 which are arranged outside the metal blocks 6, but also can be arranged within them, conduct their heat off to the metal blocks by radiation, the temperature being measured by means of the thermocouple 8. The temperature of the recording material is, as a function of its passage speed, within the range of about 100° to 150° C. The temperature in this case can be controlled in such a way that variations over the entire surface are less than about 1%. If the temperature of the metal blocks is within the range of about 110° to 140° C., a temperature variation, less than 1.5° C., is obtained, passage speeds of about 2m/min being employed in this case.

The developing chamber, according to the invention, is simple in its structure, reliable in service, and requires low maintenance. It allows a high quality development of the bubble-forming photographic recording materials. Because of its construction, it can be used for many purposes and also can be added to any dupicator.

It will be obvious to those skilled in the art that many modifications may be made within the scope of the present invention without departing from the spirit thereof, and the invention includes all such modifications.

What is claimed is:

1. In a developing chamber for developing a photographic recording material for use in the vesicular method, comprising a housing and pairs of feed and discharge rolls therein, the improvement comprising at least two heatable metal blocks within said housing at an adjustable distance with respect to each other whereby a gap for a rectilinear passage of recording material is provided, the distance between said blocks facing the gap and a surface of the recording material in said gap being in the range of about 25 to 50 μm, sliding enhancing material means in areas of said blocks facing said gap, said sliding enhancing material means being inert to said recording material, and temperature control means ensuring low temperature variations in said blocks and a temperature variation in said gap less than about ±1.5° C.

2. A developing chamber according to claim 1 in which said metal blocks are heatable to a temperature within the range of about 100° to 250° C.

3. A developing chamber according to claims 1 and 2 in which the metal blocks are heatable to a temperature within the range of about 100° to 140° C.

4. A developing chamber according to claim 1 in which said sliding enhancing material is a fabric.

5. A developing chamber according to claim 4 in which the fabirc (in which the fabric) is a polyamide fabric,

6. A developing chamber according to claim 1 including means for cooling said feed and discharge rolls.

* * * * *